US005771700A

United States Patent [19]

Cochran

[11] Patent Number: 5,771,700

[45] Date of Patent: Jun. 30, 1998

[54] HEAT PUMP APPARATUS AND RELATED METHODS PROVIDING ENHANCED REFRIGERANT FLOW CONTROL

[75] Inventor: Robert W. Cochran, Lakeland, Fla.

[73] Assignee: ECR Technologies, Inc., Lakeland, Fla.

[21] Appl. No.: 554,583

[22] Filed: Nov. 6, 1995

[51] Int. Cl.[6] ..... F25B 5/00; F25D 23/12

[52] U.S. Cl. ..... 62/117; 62/197; 62/117

[58] Field of Search ..... 62/197, 218, 160, 62/260, 117

[56] References Cited

U.S. PATENT DOCUMENTS

| | | | |
|---|---|---|---|
| 436,003 | 9/1890 | Krebs | 62/117 |
| 1,735,995 | 11/1929 | Davenport | 62/117 X |
| 2,089,851 | 8/1937 | McIntosh | 62/127 |
| 2,258,450 | 10/1941 | Graham | 62/127 |
| 3,304,738 | 2/1967 | Armstrong | 62/218 |
| 4,259,848 | 4/1981 | Voigt | 62/113 |
| 4,325,228 | 4/1982 | Wolf | 62/60 |
| 4,718,245 | 1/1988 | Steenburgh | 62/196.4 |
| 4,815,298 | 3/1989 | Steenburgh | 62/196.4 |
| 4,831,843 | 5/1989 | Cochran | 62/503 |
| 4,920,757 | 5/1990 | Gazes et al. | 62/197 X |

FOREIGN PATENT DOCUMENTS

| | | | |
|---|---|---|---|
| 3203526A | 8/1983 | Germany . | |
| 0787819 | 12/1980 | U.S.S.R. | 62/197 |

*Primary Examiner*—William E. Wayner

*Attorney, Agent, or Firm*—Allen, Dyer, Doppelt, Milbrath & Gilchrist, P.A.

[57] ABSTRACT

A heat pump apparatus includes a start assist valve for permitting refrigerant to flow from an outlet of a condenser to an inlet of an evaporator during start-up of the heat pump apparatus. The heat pump apparatus preferably includes an expansion orifice connected in fluid communication between the outlet of the condenser and the inlet of the evaporator. The start assist valve provides a bypass for refrigerant flow around the expansion orifice during start-up of the heat pump apparatus. The apparatus also preferably includes a series of check valves cooperating with the start assist valve so that the start assist valve is operable only when the heat pump apparatus is in the cooling mode. The invention is particularly applicable to a direct expansion heat pump apparatus where one or more earth tap heat exchangers serve as the condenser when operating in the cooling mode. The apparatus preferably further includes a vapor refrigerant bleed connected in fluid communication with an expansion valve for bleeding vapor therefrom. The vapor bleeding causes the expansion valve to pass a greater amount of liquid refrigerant to thereby reduce liquid refrigerant in the condenser. Method aspects of the invention are also disclosed.

46 Claims, 3 Drawing Sheets

HEAT PUMP APPARATUS AND RELATED METHODS PROVIDING ENHANCED REFRIGERANT FLOW CONTROL

FIELD OF THE INVENTION

The present invention relates to the field of heating and air conditioning, and, more particularly, to an apparatus and related methods for controlling refrigerant flow during start-up and operation of a heat pump.

BACKGROUND OF THE INVENTION

Heat pumps have become increasing popular because of the energy efficiency in transferring rather than creating heat. A heat pump typically includes a compressor which circulates refrigerant through a first heat exchanger or condenser, through an expansion valve, through a second heat exchanger or evaporator, and into an accumulator. A heat pump can commonly be operated in either a heating or cooling mode by selective activation of a reversing valve.

Air source heat pumps which exchange heat with ambient air have been most common because of their generally low initial cost. Another type of heat pump is the ground-coupled heat pump which transfers heat with the ground through a heat exchanger commonly called an earth loop or earth tap. A ground-coupled heat pump is typically more efficient than an air source heat pump because the earth temperature may be more stable than ambient air.

Among the ground-coupled heat pumps are the direct expansion and closed loop types. The closed loop heat pump typically includes an intermediate fluid, such as an anti-freeze solution, which is circulated between one or more buried conduits and a heat exchanger as disclosed, for example, in U.S. Pat. No. 4,325,228. In other words, an extra stage of heat exchange is required in the closed loop heat pump.

The direct expansion heat pump circulates refrigerant directly through one or more earth tap heat exchangers, and may be more efficient than a closed loop heat pump. A typical U-shaped earth tap heat exchanger includes two parallel conduits joined in fluid communication at their adjacent lower ends. One conduit carries liquid refrigerant and the other vapor refrigerant. Coaxial or concentric tubes for liquid and vapor refrigerant are also disclosed, for example, in German Pat. No. 3,203,526A.

Unfortunately, a ground-coupled direct expansion heat pump may require a relatively large amount of refrigerant compared with an air-source heat pump, or a closed loop heat pump. In addition, a direct expansion heat pump may accumulate a large portion of liquid refrigerant in the earth tap heat exchanger. For example, when the compressor cycles on in the cooling mode, it may be difficult to move the liquid refrigerant from the earth tap and back into circulation within the system.

In other words, if the earth tap heat exchanger is well below its typical operating temperature at the time the heat pump is started, the vapor pumped into the first heat exchanger by the compressor will be rapidly condensed, and the pressure in the earth tap will be well below normal operating pressure, and, therefore, unable to push enough liquid refrigerant through the expansion valve to sustain heat pump start-up. Typically, the suction pressure of the compressor drops due to a lack of liquid entering the evaporator, which, in turn, reduces the compressor discharge further. This effect progresses until the heat pump apparatus shuts down upon reaching a low pressure limit.

Another difficulty with a direct expansion heat pump apparatus also relates to control of refrigerant flow and also when operating in a cooling mode. A typical direct expansion heat pump apparatus may include an expansion valve or expansion orifice for restricting or controlling the flow of liquid refrigerant from the earth tap to the evaporator and responsive to a proportion of vapor refrigerant being received from the earth tap. In the cooling mode, some of the liquid refrigerant condensed in the earth tap heat exchanger may re-evaporate in the liquid line of the earth tap causing the expansion valve to receive a false vapor signal. The false vapor signal may then cause the expansion valve to reduce the amount of liquid refrigerant released to the evaporator, thereby causing additional liquid to back up in the earth tap.

Some liquid refrigerant may re-evaporate as it rises in the liquid line of the earth tap heat exchanger. The re-evaporation may be caused by the pressure drop due to the flow in a relatively narrow liquid line, and/or due to diminishing liquid column pressure. The re-evaporated refrigerant in the liquid line may also be due to heat from the adjacent vapor line. Accordingly, the false vapor signal thereby created may cause a significant and undesirable portion of liquid refrigerant to be maintained in the lower portion of the earth tap. Even when the apparatus reaches equilibrium, a significant portion of liquid refrigerant may remain in the earth tap or other condenser. The net result is that the backed up liquid refrigerant decreases the overall operating efficiency of the heat pump apparatus, as that portion of the vapor line filled with liquid refrigerant is no longer effective as a condenser.

SUMMARY OF THE INVENTION

In view of the foregoing background, it is therefore an object of the present invention to provide a heat pump apparatus and associated method for facilitating start-up and increasing the efficiency of the heat pump apparatus.

It is another object of the present invention to provide a heat pump apparatus and associated method for reducing liquid refrigerant in the condenser, particularly when starting or operating in the cooling mode, and wherein the condenser is provided by an earth tap heat exchanger.

These and other objects, advantages, and features of the present invention are provided by a heat pump apparatus including start assist valve means for permitting refrigerant to flow from an outlet of the condenser to an inlet of the evaporator during start-up of the heat pump apparatus. The heat pump apparatus preferably further comprises expansion means connected in fluid communication between an outlet of the condenser and an inlet of the evaporator for restricting a flow of refrigerant from the condenser to the evaporator. The start assist valve means provides a bypass for refrigerant flow around the expansion means during start-up of the heat pump apparatus. In addition, the start assist valve means preferably permits both liquid and vapor refrigerant to flow from the outlet of the condenser to the inlet of the evaporator when in the open position.

The heat pump apparatus may also preferably include reversing valve means for permitting selective operation of the heat pump apparatus in one of a cooling mode and a heating mode. Since the start assist is typically only needed in the cooling mode, the apparatus also preferably includes check valve means cooperating with the start assist valve means so that the start assist valve means is operable only when the heat pump apparatus is in the cooling mode. The present invention is particularly applicable to a direct expansion heat pump apparatus where one or more earth tap heat exchangers serve as the condenser when operating in the cooling mode.

The expansion means may be provided by liquid refrigerant flow control means for passing liquid refrigerant responsive to a proportion of vapor refrigerant received thereat. In this embodiment, the apparatus preferably further includes vapor refrigerant bleed means connected in fluid communication with the liquid refrigerant flow control means for bleeding vapor therefrom. The vapor bleeding causes the liquid refrigerant flow control means to pass a greater amount of liquid refrigerant to thereby reduce liquid refrigerant in the condenser. This feature is also desirable in the cooling mode and when an earth tap heat exchanger is serving as the condenser. The check valve means may also ensure that the vapor refrigerant bleed means is operable only in the cooling mode. Moreover, the vapor refrigerant bleed means may also be beneficially used in some heat pump embodiments without the start assist valve means.

The start assist valve means may be provided by a start assist valve connected in fluid communication between the outlet of the condenser and the inlet of the evaporator, and valve control means associated with the start assist valve. The valve control means is preferably for moving the start assist valve from the open position to the closed position responsive to reaching a predetermined heat pump operating condition. For example, the valve control means may comprise differential pressure actuating means for moving the start assist valve to the closed position responsive to a differential pressure between high and low pressure sides of the heat pump apparatus. In other embodiments, the valve control means is provided by a solenoid actuator and one or more sensors for sensing refrigerant pressure and/or temperature at the high or low pressure sides of the heat pump apparatus.

A method aspect of the present invention is for operating a heat pump apparatus comprising a condenser, an evaporator, and a compressor for circulating refrigerant through the condenser and the evaporator. The method preferably comprises the steps of: passing refrigerant from the condenser to the evaporator through an expansion orifice; and bypassing the expansion orifice during start-up of the heat pump apparatus by permitting refrigerant to flow from the outlet of the condenser to the inlet of the evaporator during start-up of the heat pump apparatus. The step of bypassing the expansion orifice is preferably permitted only when the heat pump apparatus is operating in a cooling mode.

Another method aspect of the present invention also relates to control of liquid refrigerant, especially when the heat pump apparatus includes an earth tap heat exchanger. The method preferably includes the steps of passing refrigerant from the condenser to the evaporator through an expansion valve, the expansion valve being of a type for passing liquid refrigerant from the condenser to the evaporator responsive to a proportion of vapor refrigerant received thereat; and bleeding vapor refrigerant from the expansion valve for causing the expansion valve to pass a greater amount of liquid refrigerant through to the evaporator to thereby reduce liquid refrigerant in the condenser. The step of bleeding refrigerant vapor from the expansion valve is also preferably permitted only when the heat pump apparatus is operating in a cooling mode.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, applicant provides these embodiments so that this disclosure will be thorough and complete, and will fully convey the scope of the invention to those skilled in the art. Like numbers refer to like elements throughout. Prime notation is used to indicate similar elements in an alternate embodiment.

Figure 1:
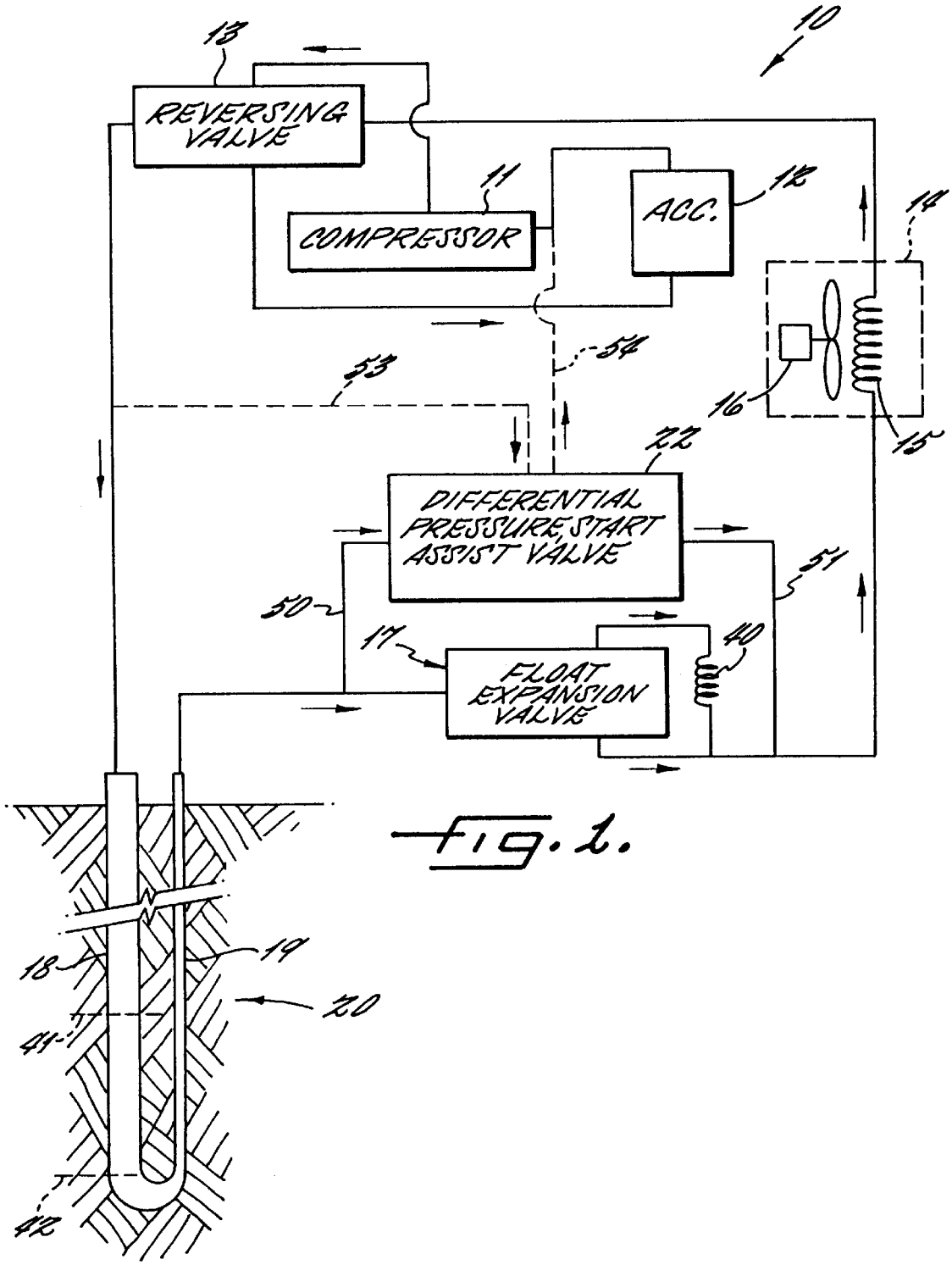
FIG. 1 is a schematic diagram of a heat pump apparatus in accordance with the present invention.
Figure 2:
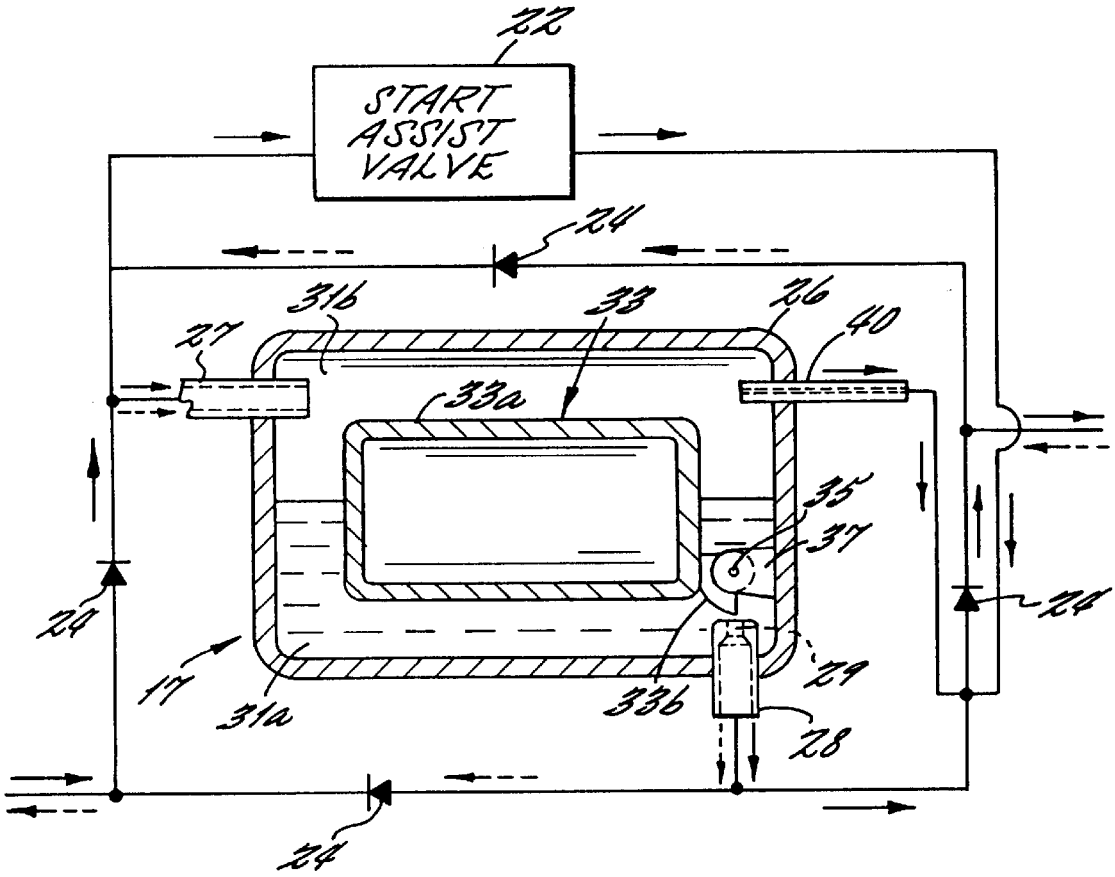
FIG. 2 is an enlarged schematic cross-sectional diagram of the liquid refrigerant flow control valve, vapor bleed, and start assist valve in accordance with the present invention.

Referring generally to the drawing FIGS. 1 and 2, an embodiment of the heat pump apparatus 10 and including an earth tap heat exchanger 20 in accordance with the invention is first described. The heat pump apparatus 10 includes an air handler 14 including a blower 16 and a first heat exchanger 15 as would be readily understood by those skilled in the art. In addition, the illustrated heat pump apparatus 10 includes a compressor 11, and a refrigerant accumulator 12. A refrigerant charge control device may be used in place of a conventional accumulator 12 as disclosed in U.S. Pat. Nos. 4,665,716 and 4,573,327, assigned to the assignee of the present invention, and the entire disclosures of which are incorporated herein by reference. The refrigerant charge control device is capable of maintaining a desired quantity of refrigerant in active circulation within the heat pump apparatus 10.

The expansion valve may preferably be provided by a float-type liquid refrigerant flow control valve 17 as described in the above identified U.S. patents to Cochran. Other conventional mechanical, electronic, electrical and electromechanical expansion valves may also be used, as would be readily understood by those skilled in the art.

The compressor 11 circulates refrigerant through the first heat exchanger 15 and through the illustrated earth tap heat exchanger 20. Although one earth tap heat exchanger 20 is illustrated, a plurality of earth taps may be used via a suitable manifold. In addition, the illustrated heat pump apparatus 10 includes a conventional reversing valve 13 for permitting selective operation of the apparatus in either a heating or cooling mode, as would be readily understood by those skilled in the art.

The illustrated earth tap heat exchanger 20 includes a vapor conduit 18 and an adjacent liquid conduit 19 connected together at their respective lower ends. The earth tap heat exchanger 20 may be buried in soil, positioned partly in water and soil, or positioned entirely in a body of water if nearby. In other words, the earth tap heat exchanger 20 may be positioned in soil or water.

When the heat pump apparatus 10 is operating in the heating mode, liquid refrigerant is delivered to the upper end of the liquid carrying conduit 19 and proceeds downward therethrough, and enters the lower end portion of the vapor refrigerant conduit 18. The liquid refrigerant evaporates within the vapor refrigerant conduit 18, thereby extracting heat from the surrounding soil or water.

Ideally, when the heat pump apparatus 10 is operating in the cooling mode, hot refrigerant vapor is delivered to the upper end of the vapor refrigerant conduit 18, flows downward therethrough and condenses to liquid, which, in turn, is withdrawn from the liquid carrying conduit 19. The hot refrigerant vapor transfers heat to the surrounding earth or soil.

For clarity of explanation, the heat pump apparatus 10 illustrated in FIG. 1 includes solid directional arrows indicating the flow of refrigerant when the heat pump 10 is in the cooling mode. Accordingly, the earth tap heat exchanger 20 is operating as a condenser, while the other heat exchanger 15 is operating as an evaporator. In the illustrated embodiment, the apparatus 10 includes a differential pressure start assist valve 22 for permitting refrigerant to flow from an outlet of the earth tap heat exchanger 20 to an inlet of the evaporator 15 during start-up of the heat pump apparatus 10.

The differential pressure start assist valve 22 provides a bypass for refrigerant flow around the expansion valve 17 during start-up of the apparatus 10. In addition, the start assist valve 22 preferably permits both liquid and vapor refrigerant to flow from the outlet of the earth tap heat exchanger 20 to the inlet of the evaporator 15.

Considered in somewhat different terms, the apparatus 10 preferably includes start assist valve means including a start assist valve and valve control means for moving the start assist valve from the open position to the closed position responsive to reaching a predetermined heat pump operating condition. For example, in the embodiment illustrated in FIG. 1, the valve control means comprises differential pressure actuating means for moving the start assist valve to the closed position responsive to a differential pressure between high and low pressure sides of the heat pump apparatus 10 reaching a predetermined level.

As would be readily understood by those skilled in the art, the high and low pressure sides of the heat pump apparatus 10 are defined by the compressor 11 and expansion valve 17, wherein the high pressure side is between the outlet of the compressor and the orifice of the expansion valve, and the low pressure side is between the orifice of the expansion valve and the inlet of the compressor. For example, for R-22 refrigerant, a differential pressure of about 60 PSI would preferably cause the start assist valve 22 to move to the closed position. At lower pressures, the start assist valve 22 would remain open.

The differential pressure start assist valve 22 may be connected to the low pressure side via low pressure conduits 51 or 54. The differential pressure start assist valve 22 may be connected to the high pressure side via high pressure connecting conduits 50 or 53 illustrated by broken lines.

Turning now more particularly to FIG. 2, since the start assist is typically only needed when the heat pump apparatus 10 is in the cooling mode, the apparatus also preferably includes check valve means cooperating with the differential pressure start assist valve 22 so that the start assist valve may be enabled to pass refrigerant only when the heat pump apparatus is in the cooling mode. The check valve means may preferably be provided by the illustrated configuration of directional check valves 24. The flow of refrigerant for the heating mode is illustrated by the broken line arrows, while the solid arrows indicate refrigerant flow during the cooling mode.

The float expansion valve 17 provides expansion means in the form of liquid refrigerant flow control means for passing liquid refrigerant responsive to a proportion of vapor refrigerant received from the earth tap heat exchanger 20 and connecting lines. The float expansion valve 17 includes a housing 26, and a refrigerant inlet tube 27 and outlet tube 28 in fluid communication with an interior defined by the housing. The housing 26 contains both liquid refrigerant 31*a* and vapor refrigerant 31*b* therein.

The float expansion valve 17 also includes a float 33, in turn, comprising a body portion 33*a* and a metering portion 33*b* connected together and pivotally connected to a sidewall portion of the housing 26 by a bracket 37 and hinge pin 35 as shown in the illustrated embodiment. The level of liquid refrigerant 31*a* within the housing 26 moves the float 33 so that the metering portion 33*b* controls a flow of liquid refrigerant into and through a metering orifice 29 provided at the end of the outlet tube 28. As the level of liquid refrigerant 31*a* decreases, or conversely as the vapor space above the liquid increases, the outflow of liquid refrigerant is reduced to increase the pressure in the earth tap heat exchanger 20.

When the float expansion valve 17 reaches equilibrium, a significant amount of liquid refrigerant may be backed up in the earth tap 20 due to a false signal reaching the valve 17. The false signal may be created by friction and pressure drop in liquid line 19, and proximity of the liquid line to the hot vapor conduit 18. This backed up liquid is subcooled sufficiently so that it can withstand most of the pressure drop and warming of the liquid conduit 19 before it begins to re-evaporate. The float expansion valve 17 is able to operate based on the small amount that re-evaporates as though it were a true signal. Moreover, with a significant portion of the earth tap heat exchanger 20 being used only for subcooling, less of the heat exchanger is available for condensing; therefore, the compressor discharge is increased and, in turn, power consumption increases. In other words, the re-evaporation in the liquid conduit 19 results in a loss of efficiency and a substantial increase in the amount of refrigerant required.

The difficulty with respect to a false vapor signal is addressed by the provision of vapor refrigerant bleed means, such as may be provided by the illustrated capillary tube 40 or other tube with a relatively small orifice, connecting the upper portion of the housing 26 of the float expansion valve 17 (the high pressure side of the apparatus) with the refrigerant line connecting the outlet of the float expansion valve with the inlet of the evaporator 15 (the low pressure side of the apparatus). The vapor refrigerant bleed means is preferably sized to account for the amount of vapor re-evaporation in the liquid conduit 19 to provide a reduction in the amount of backed up liquid refrigerant in the earth tap heat exchanger 20. Referring to the lower left hand portion of FIG. 1, the improvement in the level of backed up liquid refrigerant is shown by a difference in the upper level 41, as would occur without the vapor refrigerant bleed, and the lower level 42, as is achieved using the vapor bleed feature in accordance with the present invention.

The vapor bleed feature is also desirable in the cooling mode, and when an earth tap heat exchanger 20 is serving as the condenser. Accordingly, the illustrated check valve means provided by the check valves 24 also ensures that the vapor bleed means is operable only in the cooling mode.

Figure 3:
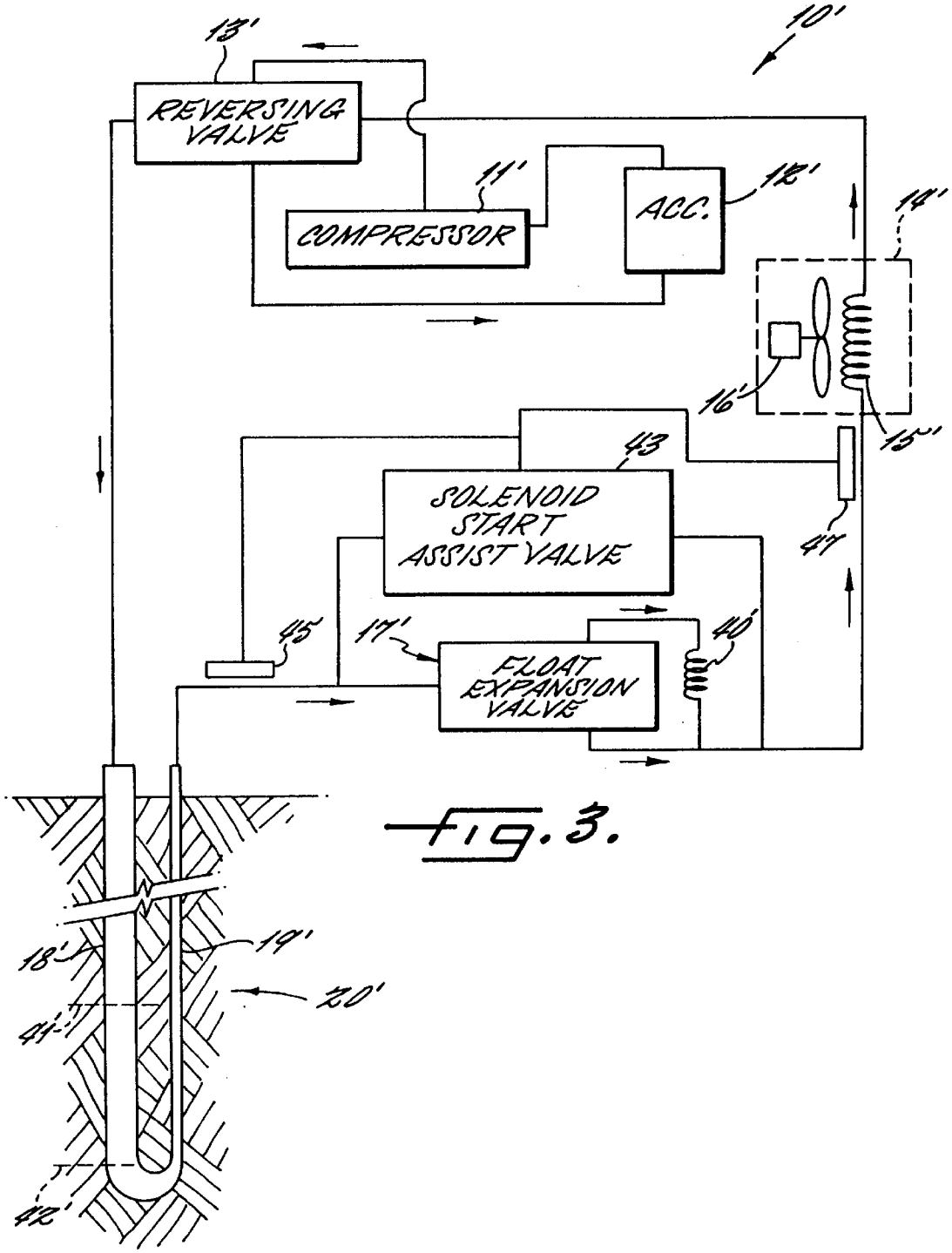
FIG. 3 is a schematic diagram of another embodiment of a heat pump apparatus in accordance with the present invention.

Turning now additionally to FIG. 3, another embodiment of the heat pump apparatus 10' according to the invention is described. In this embodiment, the start assist valve means comprises a solenoid actuated valve 43 as would be readily understood by those skilled in the art. The solenoid start assist valve 43 may be operated based upon a predetermined pressure or temperature sensed by a sensor 45 associated with the high pressure side of the heat pump apparatus 10'. For example, for R-22 refrigerant, the solenoid start assist valve may be closed when the high side pressure reaches about 125 PSI or the temperature reaches about 72 degrees F. The start assist valve moves to the open position at a lower pressure or temperature.

Alternatively, a low side pressure or temperature sensor 47 may be associated with the low pressure side of the apparatus. The low pressure side sensor 47 may operate at a pressure of about 60 PSI or a temperature of about 34 degrees F. as would be readily understood by those skilled in the art.

The other components illustrated in FIG. 3 are indicated by prime notation and are similar to those having the same numeral as shown in FIG. 1 and described above. Accordingly, these components need no further description herein.

A method aspect of the present invention is for operating a heat pump apparatus 10 comprising a condenser or earth tap heat exchanger 20, an evaporator 15, and a compressor 11 for circulating refrigerant through the condenser and the evaporator. The method preferably comprises the steps of: passing refrigerant from the condenser 20 to the evaporator 15 through an expansion orifice or expansion valve 17; and bypassing the expansion valve during start-up of the apparatus by permitting refrigerant to flow from the outlet of the condenser to the inlet of the evaporator during start-up of the heat pump apparatus 10. The step of bypassing the expansion valve is preferably permitted only when the heat pump apparatus is operating in a cooling mode.

Another method aspect of the present invention also relates to control of liquid refrigerant, especially when the heat pump apparatus 10 includes an earth tap heat exchanger 20. The method preferably includes the steps of passing refrigerant from the condenser 20 to the evaporator 15 through an expansion valve 17, the expansion valve being of a type for passing liquid refrigerant from the condenser to the evaporator responsive to a proportion of liquid and vapor refrigerant received thereat; and bleeding refrigerant vapor from the expansion valve for causing the expansion valve to pass a greater amount of liquid refrigerant through to the evaporator to thereby reduce liquid refrigerant in the condenser. The step of bleeding vapor from the expansion valve is also preferably permitted only when the heat pump apparatus is operating in a cooling mode.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A heat pump apparatus comprising:

a condenser, an evaporator, and a compressor for circulating refrigerant through said condenser and said evaporator;

expansion means connected in fluid communication between an outlet of said condenser and an inlet of said evaporator for restricting liquid refrigerant flow from said condenser to said evaporator; and start assist valve means movable between open and closed positions for permitting liquid refrigerant to flow from the outlet of said condenser to the inlet of said evaporator during start-up of the heat pump apparatus to thereby provide a bypass for liquid refrigerant flow around said expansion means during start-up of the heat pump apparatus.

2. A heat pump apparatus according to claim 1 wherein said condenser comprises an earth tap heat exchanger positioned in soil or water.

3. A heat pump apparatus according to claim 1 wherein said heat pump apparatus further comprises:

reversing valve means for permitting selective operation of the heat pump apparatus in one of a cooling mode and a heating mode; and check valve means, cooperating with said start assist valve means, for enabling said start assist valve means to pass refrigerant only when said heat pump apparatus is in the cooling mode.

4. A heat pump apparatus according to claim 1 wherein said expansion means comprises liquid refrigerant flow control means for controlling a flow of liquid refrigerant responsive to a proportion of vapor refrigerant received thereat.

5. A heat pump apparatus according to claim 4 further comprising vapor refrigerant bleed means connected in fluid communication with said liquid refrigerant flow control means for bleeding vapor therefrom for causing said liquid refrigerant flow control means to pass a greater amount of liquid refrigerant to said evaporator to thereby reduce liquid refrigerant in said condenser.

6. A heat pump apparatus according to claim 4 wherein said liquid refrigerant flow control means comprises:

a housing; and a float positioned within said housing and comprising a metering portion being movable relative to an expansion orifice to control a flow of liquid refrigerant passing to said evaporator.

7. A heat pump apparatus according to claim 1 wherein said start assist valve means comprises:

a start assist valve connected in fluid communication between the outlet of said condenser and the inlet of said evaporator; and valve control means associated with said start assist valve for moving said start assist valve from the open position to the closed position responsive to reaching a predetermined heat pump apparatus operating condition.

8. A heat pump apparatus according to claim 7 wherein said compressor and said expansion means define high and low pressure sides of the heat pump apparatus; and wherein said valve control means comprises differential pressure actuating means for moving said start assist valve to the closed position responsive to a differential pressure between the high and low pressure sides of the heat pump apparatus.

9. A heat pump apparatus according to claim 7 wherein said valve control means comprises a solenoid actuator.

10. A heat pump apparatus according to claim 7 wherein said compressor and said expansion means define high and low pressure sides of the heat pump apparatus; and wherein said valve control means comprises:

a first pressure sensor associated with the high pressure side of the heat pump apparatus; and actuator means, cooperating with said first pressure sensor, for moving said start assist valve to the closed position responsive to a pressure at the high pressure side of the heat pump apparatus reaching a predetermined value.

11. A heat pump apparatus according to claim 7 wherein said compressor and said expansion means define high and low pressure sides of the heat pump apparatus; and wherein said valve control means comprises:

a first temperature sensor associated with the high pressure side of the heat pump apparatus; and actuator means, cooperating with said first temperature sensor, for moving said start assist valve to the closed position responsive to a temperature of refrigerant in the high pressure side of the heat pump apparatus reaching a predetermined value.

12. A heat pump apparatus according to claim 7 wherein said compressor and said expansion means define high and low pressure sides of the heat pump apparatus; and wherein said valve control means comprises:

a second pressure sensor associated with a low pressure side of the heat pump apparatus; and actuator means, cooperating with said second pressure sensor, for moving said start assist valve to the closed position responsive to a pressure at the lo pressure side of the heat pump apparatus reaching a predetermined value.

13. A heat pump apparatus according to claim 7 wherein said compressor and said expansion means define high and low pressure sides of the heat pump apparatus; and wherein said valve control means comprises:

a second temperature sensor associated with a low pressure side of the heat pump apparatus; and actuator means, cooperating with said second temperature sensor, for moving said start assist valve to the closed position responsive to a temperature of refrigerant in the low pressure side of the heat pump apparatus reaching a predetermined value.

14. A heat pump apparatus according to claim 1 wherein said start assist valve means comprises means for permitting both liquid and vapor refrigerant to flow from the outlet of said condenser to the inlet of said evaporator.

15. A heat pump apparatus comprising:

a condenser, an evaporator, and a compressor for circulating refrigerant through said condenser and said evaporator, said condenser comprising an earth tap heat exchanger positioned in soil or water;

expansion means connected in fluid communication between an outlet of said earth tap heat exchanger and an inlet of said evaporator for restricting refrigerant flow from said earth tap heat exchanger to said evaporator;

start assist valve means movable between open and closed positions for permitting refrigerant to flow from the outlet of said earth tap heat exchanger to the inlet of said evaporator during start-up of the heat pump apparatus to thereby provide a bypass for refrigerant flow around said expansion means during start-up of the heat pump apparatus;

reversing valve means for permitting selective operation of the heat pump apparatus in one of a cooling mode and a heating mode; and check valve means, cooperating with said start assist valve means, for enabling said start assist valve means to pass refrigerant only when said heat pump apparatus is in the cooling mode.

16. A heat pump apparatus according to claim 15 wherein said expansion means comprises liquid refrigerant flow control means for controlling a flow of liquid refrigerant responsive to a proportion of vapor refrigerant received thereat.

17. A heat pump apparatus according to claim 16 further comprising vapor refrigerant bleed means connected in fluid communication with said liquid refrigerant flow control means for bleeding vapor therefrom for causing said liquid refrigerant flow control means to pass a greater amount of liquid refrigerant to said evaporator to thereby reduce liquid refrigerant in said earth tap heat exchanger.

18. A heat pump apparatus according to claim 15 wherein said liquid refrigerant flow control means comprises:

a housing; and a float positioned within said housing and comprising a metering portion being movable relative to an expansion orifice to control a flow of liquid refrigerant passing to said evaporator.

19. A heat pump apparatus according to claim 15 wherein said start assist valve means comprises:

a start assist valve connected in fluid communication between the outlet of said earth tap heat exchanger and the inlet of said evaporator; and valve control means associated with said start assist valve for moving said start assist valve from the open position to the closed position responsive to reaching a predetermined heat pump apparatus operating condition.

20. A heat pump apparatus according to claim 19 wherein said compressor and said expansion means define high and low pressure sides of the heat pump apparatus; and wherein said valve control means comprises differential pressure actuating means for moving said start assist valve to the closed position responsive to a differential pressure between the high and low pressure sides of the heat pump apparatus.

21. A heat pump apparatus according to claim 19 wherein said valve control means comprises a solenoid actuator.

22. A heat pump apparatus according to claim 19 wherein said compressor and said expansion means define high and low pressure sides of the heat pump apparatus; and wherein said valve control means comprises means for moving said start assist valve from the open position to the closed position responsive to one of a predetermined pressure and a predetermined temperature of refrigerant in the high pressure side of heat pump apparatus.

23. A heat pump apparatus according to claim 19 wherein said compressor and said expansion means define high and low pressure sides of the heat pump apparatus; and wherein said valve control means comprises means for moving said start assist valve from the open position to the closed position responsive to one of a predetermined pressure and a predetermined temperature of refrigerant in the low pressure side of heat pump apparatus.

24. A heat pump apparatus according to claim 15 wherein said start assist valve means comprises means for permitting both liquid and vapor refrigerant to flow from the outlet of said earth tap heat exchanger to the inlet of said evaporator.

25. A heat pump apparatus comprising:

a condenser, an evaporator, and a compressor for circulating refrigerant through said condenser and said evaporator, said condenser comprising an earth tap heat exchanger positioned in soil or water;

liquid refrigerant flow control means, connected in fluid communication between an outlet of said earth tap heat exchanger and an inlet of said evaporator, for controlling a flow of liquid refrigerant from said earth tap heat exchanger to said evaporator responsive to a proportion of vapor refrigerant received thereat;

vapor refrigerant bleed means connected in fluid communication with said liquid refrigerant flow control means for bleeding vapor therefrom for causing said liquid refrigerant flow control means to pass a greater amount of liquid refrigerant to said evaporator to thereby reduce liquid refrigerant in said earth tap heat exchanger; and start assist valve means movable between open and closed positions for permitting refrigerant to flow from the outlet of said earth tap heat exchanger to the inlet of said evaporator during start-up of the heat pump apparatus to thereby provide a bypass for refrigerant flow around said liquid flow control means during start-up of the heat pump apparatus.

26. A heat pump apparatus according to claim 25 wherein said heat pump apparatus further comprises:

reversing valve means for permitting selective operation of the heat pump apparatus in one of a cooling mode and a heating mode; and check valve means, cooperating with said start assist valve means, for enabling said start assist valve means to pass refrigerant only when said heat pump is in the cooling mode and for operating said vapor bleed means only when said heat pump apparatus is in the cooling mode.

27. A heat pump apparatus according to claim 25 wherein said liquid refrigerant flow control means comprises:

a housing; and a float positioned within said housing and comprising a metering portion being movable relative to an expansion orifice to control a flow of liquid refrigerant passing to said evaporator.

28. A heat pump apparatus according to claim 25 wherein said start assist valve means comprises:

a start assist valve connected in fluid communication between the outlet of said earth tap heat exchanger and the inlet of said evaporator; and valve control means associated with said start assist valve for moving said start assist valve from the open position to the closed position responsive to reaching a predetermined heat pump apparatus operating condition.

29. A heat pump apparatus according to claim 28 wherein said compressor and said liquid refrigerant flow control means define high and low pressure sides of the heat pump apparatus and; wherein said valve control means comprises differential pressure actuating means for moving said start assist valve to the closed position responsive to a differential pressure between the high and low pressure sides of the heat pump apparatus.

30. A heat pump apparatus according to claim 28 wherein said valve control means comprises a solenoid actuator.

31. A heat pump apparatus according to claim 28 wherein said compressor and said liquid refrigerant flow control means define high and low pressure sides of the heat pump apparatus; and wherein said valve control means comprises means for moving said start assist valve from the open position to the closed position responsive to one of a predetermined pressure and a predetermined temperature of refrigerant in the high pressure side of heat pump apparatus.

32. A heat pump apparatus according to claim 28 wherein said compressor and said liquid refrigerant flow control means define high and low pressure sides of the heat pump apparatus; and wherein said valve control means comprises means for moving said start assist valve from the open position to the closed position responsive to one of a predetermined pressure and a predetermined temperature of refrigerant in the low pressure side of heat pump apparatus.

33. A heat pump apparatus according to claim 25 wherein said start assist valve means comprises means for permitting both liquid and vapor refrigerant to flow from the outlet of said earth tap heat exchanger to the inlet of said evaporator.

34. A heat pump apparatus comprising:

a condenser comprising an earth tap heat exchanger positioned in soil or water, an evaporator, and a compressor for circulating refrigerant through said condenser and said evaporator;

liquid refrigerant flow control means, connected in fluid communication between an outlet of said condenser and an inlet of said evaporator, for controlling a flow of liquid refrigerant from said condenser to said evaporator responsive to a proportion of vapor refrigerant received thereat; and vapor refrigerant bleed means connected in fluid communication between said refrigerant flow control means and said evaporator for bleeding vapor from said liquid refrigerant flow control means independent of liquid refrigerant flow through said liquid refrigerant flow control means for causing said liquid refrigerant flow control means to pass a greater amount of liquid refrigerant to said evaporator to thereby reduce liquid refrigerant in said condenser.

35. A heat pump apparatus according to claim 34 wherein said heat pump apparatus further comprises:

reversing valve means for permitting selective operation of the heat pump apparatus in one of a cooling mode and a heating mode; and check valve means cooperating with said vapor refrigerant bleed means, for enabling said vapor refrigerant bleed means only when said heat pump apparatus is in the cooling mode.

36. A heat pump apparatus according to claim 34 wherein said liquid refrigerant flow control means comprises:

a housing; and a float positioned within said housing and comprising a metering portion being movable relative to an expansion orifice to control a flow of liquid refrigerant passing to said evaporator.

37. A method for operating a heat pump apparatus comprising a condenser, an evaporator, and a compressor for circulating refrigerant through the condenser and the evaporator; the method comprising the steps of:

passing a flow of liquid refrigerant from the condenser to the evaporator through an expansion orifice; and bypassing the expansion orifice during start-up of the heat pump apparatus by permitting liquid refrigerant to flow from the outlet of the condenser to the inlet of the evaporator during start-up of the heat pump apparatus.

38. A method according to claim 37 wherein the heat pump apparatus is operable in one of a cooling mode and a heating mode; and wherein the step of bypassing the expansion orifice occurs only when the heat pump apparatus is operating in a cooling mode.

39. A method according to claim 37 further comprising the step of stopping bypassing of the expansion orifice responsive to one of a predetermined temperature and a predetermined pressure being reached in the heat pump apparatus.

40. A method according to claim 37 wherein an expansion valve defines the expansion orifice for passing liquid refrigerant from the condenser to the evaporator responsive to a proportion of vapor refrigerant received thereat; and further comprising the step of bleeding vapor refrigerant from the expansion valve for causing the expansion valve to reduce liquid refrigerant in the condenser.

41. A method according to claim 37 wherein the condenser comprises an earth tap heat exchanger positioned in soil or water.

42. A method according to claim 37 wherein the step of bypassing refrigerant comprises bypassing both liquid and vapor refrigerant.

43. A method for operating a heat pump apparatus comprising a condenser having an earth tap heat exchanger positioned in soil or water, an evaporator, and a compressor for circulating refrigerant through the condenser and the evaporator; the method comprising the steps of:

passing refrigerant from the condenser to the evaporator through an expansion valve, the expansion valve being of a type for passing liquid refrigerant from the condenser to the evaporator responsive to a proportion of vapor refrigerant received thereat; and bleeding vapor refrigerant from the expansion valve to the evaporator and independent of liquid refrigerant flow through the expansion valve for causing the expansion valve to pass a greater amount of liquid refrigerant tot he evaporator to thereby reduce liquid refrigerant in the condenser.

44. A method according to claim 43 wherein the heat pump apparatus is operable in a cooling mode and a heating mode; and wherein the step of bleeding vapor refrigerant from the expansion valve is permitted only when the heat pump apparatus is operating in the cooling mode.

45. A heat pump apparatus comprising:

a condenser, an evaporator, and a compressor for circulating refrigerant through said condenser and said evaporator;

liquid refrigerant flow control means, connected in fluid communication between an outlet of said condenser and an inlet of said evaporator, for controlling a flow of liquid refrigerant from said condenser to said evaporator responsive to a proportion of vapor refrigerant received thereat;

vapor refrigerant bleed means connected in fluid communication between said refrigerant flow control means and said evaporator for bleeding vapor from said liquid refrigerant flow control means independent of liquid refrigerant flow through said liquid refrigerant flow control means for causing said liquid refrigerant flow control means to pass a greater amount of liquid refrigerant to said evaporator to thereby reduce liquid refrigerant in said condenser;

reversing valve means for permitting selective operation of the heat pump apparatus in one of a cooling mode and a heating mode; and check valve means cooperating with said vapor refrigerant bleed means, for enabling said vapor refrigerant bleed means only when said heat pump apparatus is in the cooling mode.

46. A heat pump apparatus according to claim 45 wherein said liquid refrigerant flow control means comprises:

a housing; and a float positioned within said housing and comprising a metering portion being movable relative to an expansion orifice to control a flow of liquid refrigerant passing to said evaporator.

* * * * *

UNITED STATES PATENT AND TRADEMARK OFFICE
Certificate

Patent No. 5,771,700 Patented: June 30, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert W. Cochran and Russell W. Bath.

Signed and Sealed this First Day of August, 2000.

HENRY A. BENNETT
*Supervisory Patent Examiner*
Art Unit 3744